United States Patent [19]

Barriac

[11] Patent Number: 4,583,665

[45] Date of Patent: Apr. 22, 1986

[54] COMBINATION CONTAINER WITH MEMBRANE SEALED FINISH AND TAMPER-INDICATING DISPENSING CLOSURE

[75] Inventor: Jacques J. Barriac, Toledo, Ohio

[73] Assignee: Owens-Illinois, Inc., Toledo, Ohio

[21] Appl. No.: 669,483

[22] Filed: Nov. 8, 1984

[51] Int. Cl.[4] ..... B67B 7/26; B65D 47/10

[52] U.S. Cl. ..... 222/83; 222/91; 222/153; 222/541; 215/232; 215/249; 215/351

[58] Field of Search ..... 222/153, 81, 83, 83.5, 222/91, 541; 156/69; 215/232, 249, 247, 350, 351

[56] References Cited

U.S. PATENT DOCUMENTS

| | | | |
|---|---|---|---|
| 4,234,103 | 11/1980 | Strobl, Jr. et al. | 222/91 X |
| 4,307,821 | 12/1981 | McIntosh | 222/83 |
| 4,390,552 | 6/1983 | Niwa | 215/232 X |
| 4,418,834 | 12/1983 | Helms et al. | 215/232 X |

FOREIGN PATENT DOCUMENTS

| | | | |
|---|---|---|---|
| 367366 | 2/1932 | United Kingdom | 215/232 |

*Primary Examiner*—Joseph J. Rolla
*Assistant Examiner*—Andrew Jones
*Attorney, Agent, or Firm*—John R. Nelson

[57] ABSTRACT

A tamper-indicating closure system used with a container that has a sealing disc over the neck of the container. The closure threads onto the container neck but is held against threading down below a predetermined level by a rupturable tear band between the bottom of the closure and the shoulder of the container. A pourout dispenser feature is incorporated in the closure and after the tear band is removed, the continued threading-on of the closure will cause a member in the closure to rupture the sealing disc and the contents of the container can be poured therefrom through the closure. If the tear band is intact, tampering has not occurred.

8 Claims, 7 Drawing Figures

COMBINATION CONTAINER WITH MEMBRANE SEALED FINISH AND TAMPER-INDICATING DISPENSING CLOSURE

This invention relates to a tamper-indicating dispensing closure that is threaded on a container finish that has a membrane sealing the upper opening in the container. The closure system of the invention provides an arrangement where the closure, after a tamper-indicating band has been removed, may be threaded down on the container neck to affect the puncture and clearing of a significant portion of the membrane so that the product in the container may be dispensed from the dispensing closure without removal of the closure from the container.

BACKGROUND OF THE INVENTION

In the closure art may be found numerous examples of dispensing type closures where the outer closure shell is made with either a horizontal slide that align holes or a rotatable member that brings openings into alignment upon relative rotation. These are sometimes termed "sifter fitment" type closures when one of the openings is of restricted screen size and serves to "sift" the contents of the containers that are being dispensed. Others take the form of a movable "trap" chamber which may be set to receive or trap a single article such as a tablet, or measured quantity in the case of powdered coffee, from the interior of the container when in one position and upon movement to a second position will dispense this quantity or tablet while closing the top of the container against further acceptance of product from the container.

These dispensing closures, if applied over containers that are sealed with a membrane or metallic foil that is adhered to the container finish, would normally require removal of the closure and rupture of the membrane with reapplication of the closure to take advantage of the dispensing feature.

Obviously, when the closure is on the container, the consumer is not readily apprised of whether the foil or membrane is intact, indicating that the container has not been tampered with after sealing.

The sealing of an aluminum foil to the top of the finish, of a glass container has been the subject of several patents such as U.S. Pat. No 3,928,109, issued Dec. 23, 1975 and U.S. Pat. No. 4,396,655, issued Aug. 2, 1983. In these examples, the foil disc is formed with a heat activated material, such as an epoxy on one side, and the glass container is provided with a silane coupling agent over the rim or top of the finish which will react with the epoxy and make a vapor tight seal with the aluminum. These foils have been applied to the finish without any other supporting materials, but in some cases the foil has been supported by an annular plastic snap-on ring that locates the foil on the container after filling and holds it in place during the well-known induction type heating to activate the adhesive. The induction heating of foil disc is clearly shown in U.S. Pat. No. 3,928.109.

It would be possible to determine the integrity of this foil seal, if the container were marketed without any further cover, but due to the rather fragile nature of the foil, it is normally necessary to have a cover or cap over the foil, such as a snap cap or regular threaded cap, or perhaps a lug style closure that is frequently used with baby food jars. These overcaps must be removed in order to see the condition of the foil seal.

Tamper-indicating closure systems have become desirable and one which would work with a dispensing closure should be equally desirable.

SUMMARY OF THE INVENTION

With the foregoing in view, it is an object of the present invention to provide a dispensing style closure for a container that has a foil or other membrane sealed over the finish of the container where the integrity of the membrane may be insured prior to purchase of the package.

It is a further object of this invention to provide a dispensing closure for a membrane sealed container in which the membrane may be punctured and the closure be put in its dispensing mode without first removing the closure, yet providing a clear indication that the sealing system is still intact and that the membrane cannot have been punctured prior to receipt by the consumer.

The dispensing closure is formed with a depending skirt that threads onto the container but is held against downward movement beyond a preselected position until a lower frangible band is removed. Only after the band is removed may the closure be further rotated causing the closure, with a membrane piercing device on its underside, to puncture and clear an opening through the membrane therebeneath.

In both embodiments of the invention, the dispensing closure may be threaded on the container but will be prevented from being unthreaded by interengaging means between the bottle neck and the closure or band so that once the closure is applied, it may not be removed without destroying the integrity of the closure or band. In this manner a tamper-indicating dispensing closure and membrane sealed container system is provided where the closure, once applied in the product filling area, does not need to be removed in order to activate the dispensing feature.

DETAILED DESCRIPTION OF THE DRAWINGS

Figure 1:
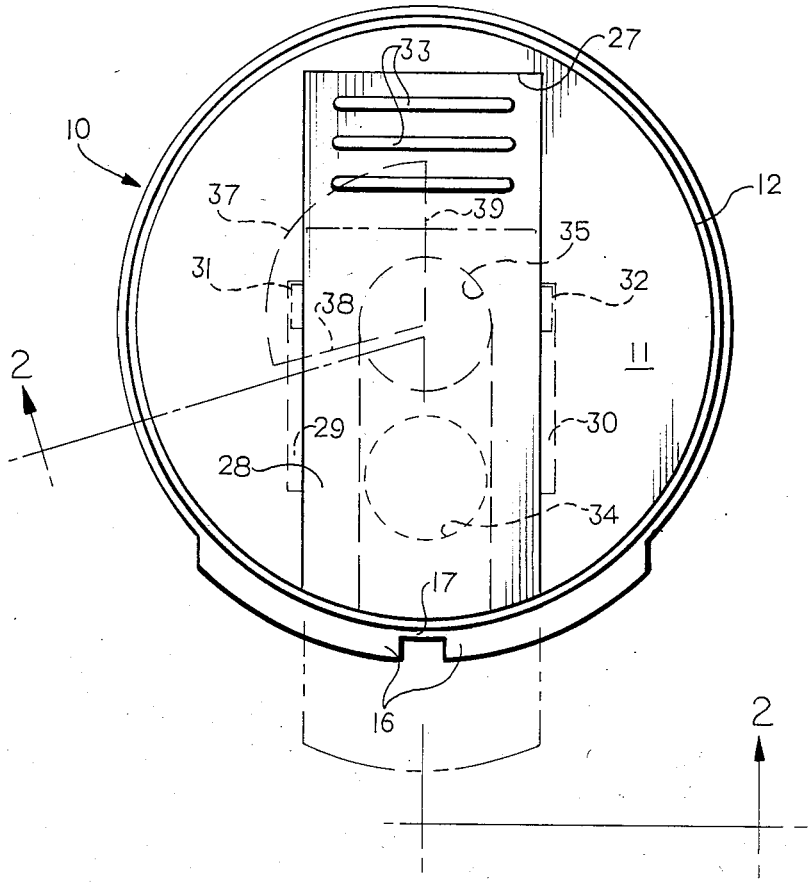
FIG. 1 is a top plan view of a first embodiment of the closure system of the invention.
Figure 2:
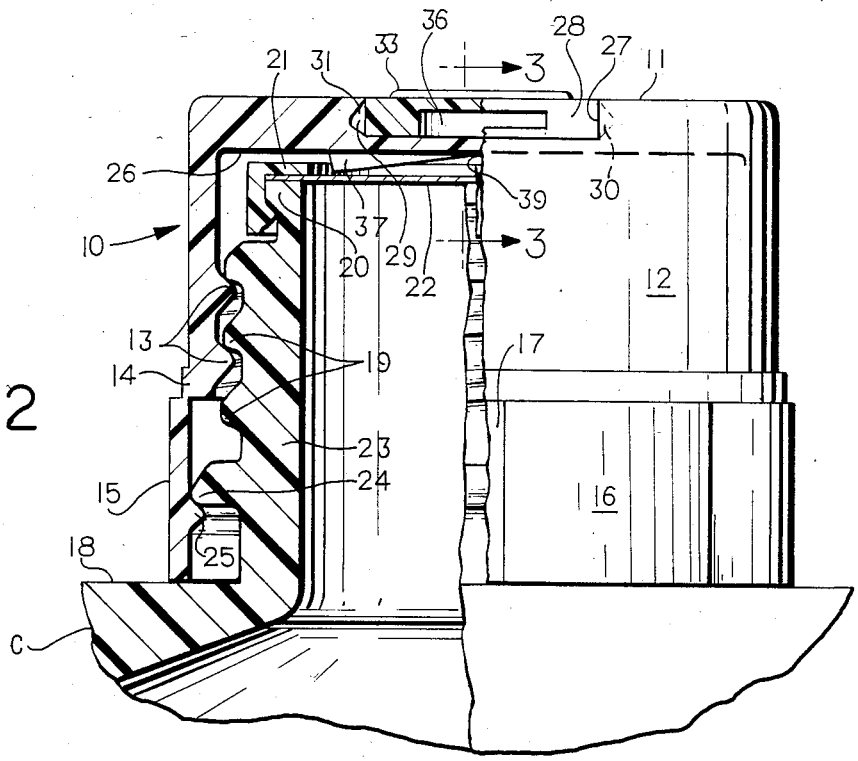
FIG. 2 is a vertical, sectional view taken at line 2—2 of FIG. 1.
Figure 3:
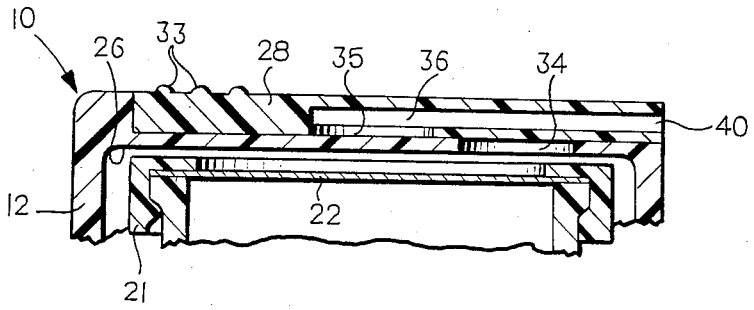
FIG. 3 is a sectional view taken at line 3—3 of FIG. 2.

With particular reference to FIGS. 1–3, the description of the first embodiment will be given and the general concepts of the invention should be readily understood.

An outer cap generally designated 10 is formed with a generally flat top 11 and downwardly extending cylindrical skirt 12. The interior of the skirt 12 is provided with threads 13. Adjacent the lower end of the skirt 12 on the outer surface area is an outwardly extending ledge 14 which may serve to aid in applying the cap to a container or bottle finish. Beneath the ledge 14 and joined integrally therewith is an annular tear band 15. The band 15, as best shown in FIG. 2, is a cylindrical skirt with a pair of outwardly extending heavier portions 16 joined together at the center by a fairly thin area 17. With the application of the cap to a container by threading the cap onto the container finish, the tear band is intended to engage a shoulder 18 of a container C. The container C has external threads 19 which cooperate with the threads 13 in the cap 10. In addition, the container C has an upper annular rim 20 with a reduced outer dimension relative to the container neck portion in which the threads 19 are formed. The rim 20 provides a snap-on area for an annular snap-over ring 21. The ring 21 or fitment carries a foil lining 22 which is adapted to seat over and seal to the annular rim 20 of the container C. In some applications, the ring or fitment 21 which snaps over the rim 20 of the finish 23 of the container will be heat sealed by induction heating to the rim of the container, it being understood that a sealing material will be interposed between the foil and the upper rim 20 of the container. The finish 23 of the container C is also provided with a radially outwardly extending ledge 24. The ledge 24 cooperates with an annular retaining bead 25 formed within the tear band inner surface. Upon application of the cap 10 to the finish 23 of the container C, the tear band 15 will limit the downward movement of the cap 10 and the retaining bead 25 will pass over the ledge 24 and once in the position, as illustrated in FIG. 2, it is impossible to remove the outer cap 10 without breaking the tear band.

The cap 10 is formed with a dispensing feature of a particular variety as shown in FIGS. 1 and 2. The dispensing feature is one which would be used to dispense a pourable product. The cap 10 has a generally flat inner surface 26. However, the top 11 is formed within its outer surface with a horizontally extending slot 27. As best seen in FIG. 1, the slot 27 will extend from one edge to nearly the full diameter of the cap top 11. Within this slot 27 is positioned a slide 28. The slot 27 is formed with generally vertical walls extending from its bottom to its top except in two horizontally extending areas 29 and 30, of limited extent, on either side of the slot.

As best shown in FIG. 2, the outer edges of these areas are generally V-shaped and are adapted to receive a pair of complimentary V-shaped ears or extentions 31 and 32 on the slide. As can be seen in FIG. 1, the areas 29 and 30, shown in dotted line, extend from slightly beyond the center area of the cap to a position adjacent the front end. The extensions or ears 31 and 32 of the slide 28 are snapped into the areas 29 and 30 respectively and limit the movement of the slide 28 relative to the cap 10 to the length of the areas 29 and 30. The slide 28 is shown in FIG. 1 in full line in its retracted position. However, it may be moved to the dotted line position by engaging a series of ridges or ribs 33 with a finger or thumb and pushing the slide outwardly. Through the lower surface 26, of the cap 10, there is provided a round opening 34. The slide 28 is likewise provided with an opening 35. The opening 35 extends through the bottom of the slide and communicates with a hollow, elongated compartment 36 in the slide 28. The compartment 36 extends from the front of the slide 28 back to the opening or hole 35 and overlies the entire hole 35.

The inner or lower surface 26 of the cap 10 is formed with a downwardly extending, sharp-edged wedge 37. The wedge 37 is at its lowest extent at an edge 38 and tapers upwardly and inwardly toward a radial line 39 where it generally merges with the surface 26. With the closure of the invention applied to a container finish as illustrated in FIGS. 1 and 2 the wedge 37 is held in its elevated position above the membrane or foil 22 by the tear band 16 and thus, when the product is on the shelf, there will be an indication of whether or not the container and foil seal has been tampered with, depending on whether the tear band 16 is still intact.

Once the product is acquired by the consumer, the dispensing feature of the closure may be activated and the foil pierced without removing the cap 10 from the container finish 23. All the consumer needs to do is remove the tear band 16 and then thread the outer cap 10 down on the container until the lower surface 26 engages the fitment 21. Once this has been accomplished, the wedge 37 will have perforated and removed a portion of the foil or membrane 22, opening the interior of the container to the opening 34 in the cap 10. Then by sliding the slide 28 to the right, as viewed in FIG. 3, the opening 34 will become aligned with the opening 35 and by tilting the container, the contents may be poured through the openings 34 and 35 into the compartment 36. As previously stated, the compartment 36 in the slide 28 opens to the outside, for example as shown at 40 in FIG. 3. Returning the slide to the position shown in FIG. 3 would close off the interior of the container from the outside and disrupt the dispensing feature.

Turning now to FIGS. 4–7, there is shown a second embodiment of the invention. The pourout or dispensing feature of this second embodiment is essentially identical to that of the first embodiment set forth in FIGS. 1–3, and description of the dispensing feature of the second embodiment will be dispensed with and only that portion which is different will be described in detail.

A cap 41 is formed with a cylindrical skirt portion 42 having internal threads 43 formed therein. Above the threads 43 on the interior of the skirt 42, there is formed an inwardly extending bead 44. The bead 44 serves as a retainer to a ring or fitment 45 that has a foil 46 carried thereby. The fitment 45 and foil 46 snap over the upper finish of the container, as in the first embodiment and the foil may be heat sealed to the upper surface of the container. In this embodiment, however, it should be pointed out that the fitment 45 has a radially outwardly extending annular boss 47 which is positioned below the bead 44 and the fitment and the closure or cap 41 may be marketed with the two members disassembled and sealing of the foil may be accomplished before the cap has been put over the finish of the container.

Figure 6:
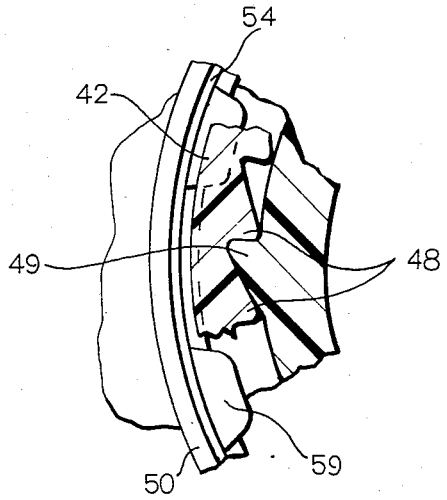
FIG. 6 is a partial sectional view, on an enlarged scale, taken at line 6—6 of FIG. 5.

The lower inside portion of the skirt 42 is provided with internal notches or teeth 48 as best seen in FIG. 6. The teeth 48 cooperate with one or more outwardly extending fixed pawls 49. As can be seen when viewing FIG. 5, the teeth 48 extend downward from above the lower end of the skirt 42 and out through the bottom end of the skirt. When the closure is applied to a container and threaded thereon, the ratcheting arrangement will permit the cap to be rotated clockwise and when the lower end of the cap reaches the pawls 49, it may only be turned clockwise and cannot be reversed in direction or unthreaded from the container.

Figure 7:
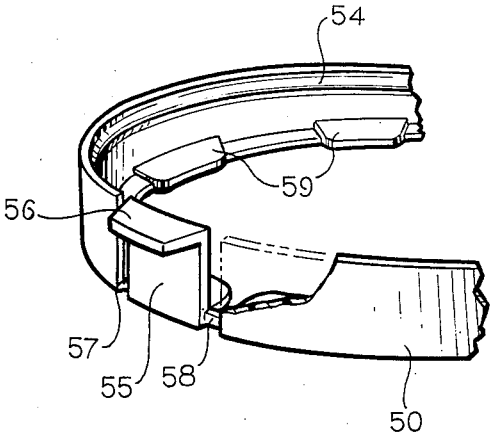
FIG. 7 is a schematic, perspective view of a portion of the tear band of the embodiment of FIGS. 4–6.
Figure 4:
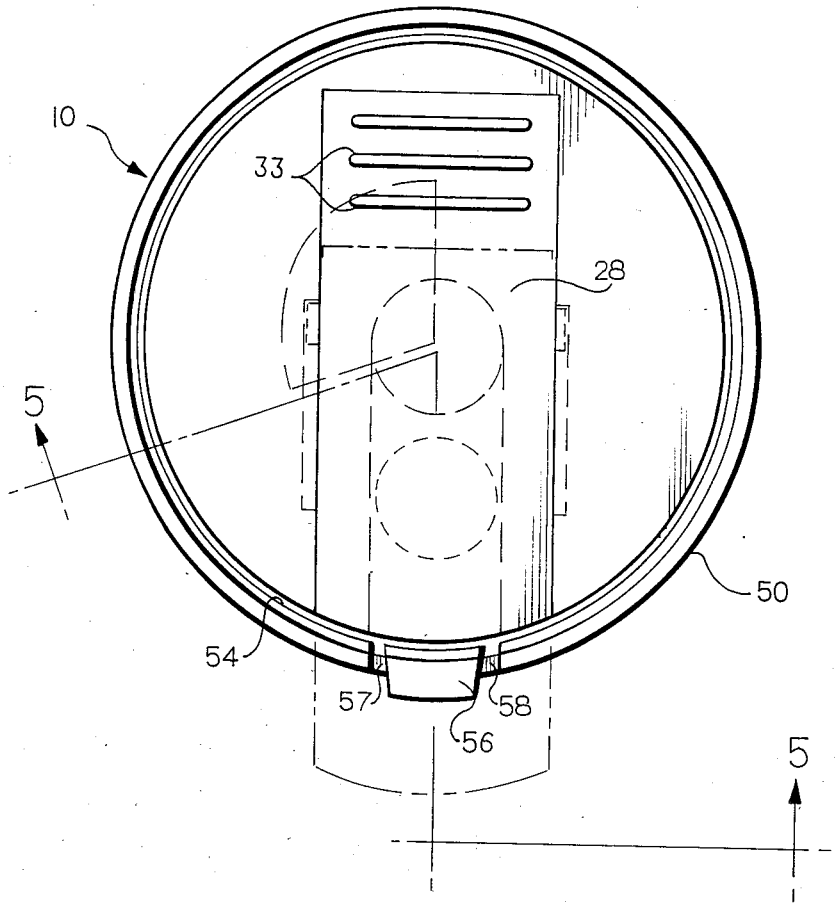
FIG. 4 is a top plan view of a second embodiment of the closure system of the invention.
Figure 5:
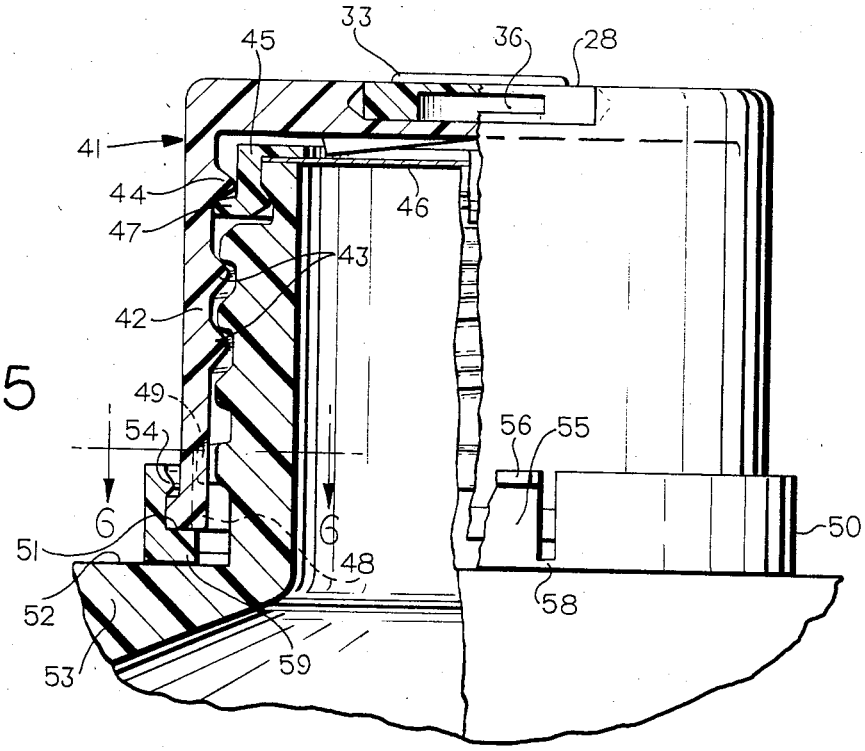
FIG. 5 is a vertical, sectional view taken at line 5—5 of FIG. 4.

A pilfer-indicating band 50 fits about the lower end of the skirt 42 and is positioned between the bottom 51 and a shoulder 52 of the bottle or container 53. As can be seen, the band 50 controls or limits the downward position of the cap relative to the container shoulder 52. In the position as shown in FIG. 5, the wedge 37 of the pourout portion of the cap is prevented from penetrating the foil 46 by the interposition of the band 50 beneath the bottom 51 of the cap skirt and the container shoulder 52. The details of the tear band 50 is shown in FIG. 7 wherein it can be seen that the tear band is formed of essentially a continuous ring of plastic having an inner bead 54 near its top. The bead 54 is adapted to snap over the lower end of the skirt 42 of the closure and be retained thereon. The band 50 is interrupted in its circumferential extent by a tear strip 55. The tear strip 55 has a pull tab portion 56 and is joined to the main portion of the ring 50 by thin bridging members 57 and 58. Inwardly extending bosses 59 complete the configuration of the band 50. The bosses 59 serve as platforms upon which the lower rim of the cap will be positioned.

When it is desired to activate the pourout fitment, it is necessary to remove the tear band 50 and thread the closure down onto the finish of the container, as in the first embodiment, causing the wedge 37 to pierce the foil 46. Then through the manipulation of the slide, the pourout fitment may be operated and the contents of the package may be dispensed as set forth with respect to the earlier embodiment.

While the particular pourout feature is shown as being one that operates with a slide, it should be equally apparent that other types of pourout fitments may be used in place thereof with the essential feature being that a sealing foil be puncturable after a tear band or tamper-indicating band has been removed from the system and the puncturing occurring after such removal. Thus there is provided a closure with a pourout fitment for a bottle or container in which the integrity of the contents may be assured and that the contents may be dispensed after removal of a tear band without requiring removal of the outer closure.

I claim:

1. A dispensing closure system in combination with a container having external threads on the finish and a closure having a generally planar top with a dispensing feature formed therein in the top, an integral, downwardly extending annular skirt with thread engaging means formed internally thereof, annular, rupturable band extending below the bottom of the closure skirt, said rupturable band seating on a generally horizontal area of the container below the external threads for maintaining a predetermined spacing between a membrane disc rupturing means carried by the underside of the closure top and a finish sealing, membrane disc adapted to be supported by an annular snap-on fitment, the improvement wherein said fitment is formed with an outwardly extending annular boss adapted to engage the interior of said closure skirt above the thread engaging means therein, and an inwardly extending annular bead formed in the skirt of said closure in overlying relationship to the annular boss on said fitment, whereby assembly of the closure and fitment to a container finish may be accomplished without rupture of the disc.

2. The system of claim 1 wherein said membrane is supported by a snap-on annular fitment overlying the outer edge of the membrane, said fitment adapted to snap over the container finish rim.

3. The system of claim 2 wherein said membrane disc is an aluminum foil, heat sealed to the top, finish rim of the container.

4. The system of claim 2 wherein said membrane disc is a thin, vapor impervious sheet adhesively adhered to the top finish rim of the container.

5. The closure system of claim 1 further including interengaging means between said closure skirt and container neck beneath the threads thereon for permitting threading-on of the closure but preventing reverse or unthreading of the closure from the container.

6. The closure system of claim 5 wherein said interengaging means comprises at least one integrally formed, radially extending tooth on the circumference of said container neck and a plurality of inwardly extending, beveled teeth forming an inward facing ratchet wheel in the skirt of said closure.

7. The closure system of claim 1 wherein said rupturable band is formed integrally with the closure skirt and connected thereto by a thin area.

8. The closure system of claim 7 further including an inwardly extending bead on said band and an outwardly extending circumferential ledge on said container, said bead passing beneath said ledge upon applying the closure to the container initially but being incapable of passing over the ledge in the opposite direction without rupture of the band.

* * * * *